US010990033B2

(12) United States Patent
Onodera

(10) Patent No.: US 10,990,033 B2
(45) Date of Patent: Apr. 27, 2021

(54) IMAGE FORMING APPARATUS THAT CHANGES TONER REPLENISHMENT AMOUNT BASED ON PREDICTED AND DETECTED TONER CONCENTRATION VALUES

(71) Applicant: KYOCERA Document Solutions Inc., Osaka (JP)

(72) Inventor: Takuya Onodera, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/936,572

(22) Filed: Jul. 23, 2020

(65) Prior Publication Data

US 2021/0026271 A1 Jan. 28, 2021

(30) Foreign Application Priority Data

Jul. 26, 2019 (JP) ..... JP2019-138332

(51) Int. Cl.
*G03G 15/08* (2006.01)

(52) U.S. Cl.
CPC ..... *G03G 15/0849* (2013.01); *G03G 15/0865* (2013.01); *G03G 2215/0888* (2013.01)

(58) Field of Classification Search
CPC ..... G03G 15/0849; G03G 15/0853; G03G 15/0865; G03G 2215/0888; G03G 15/0877; G03G 21/20
USPC ..... 399/27, 30, 44, 258
See application file for complete search history.

(56) References Cited

U.S. PATENT DOCUMENTS 6,404,997 B1 * 6/2002 Grace ..... G03G 15/0849 399/27
9,864,301 B1 * 1/2018 Ogasahara ..... G03G 15/0849

FOREIGN PATENT DOCUMENTS

JP 2012252263 A 12/2012

* cited by examiner

*Primary Examiner* — William J Royer
(74) *Attorney, Agent, or Firm* — Studebaker & Brackett PC

(57) ABSTRACT

In an image forming apparatus, a controller controls a toner container so that toner in the toner container is supplied to a developing section according to replenishment amount information stored in storage. The developing section includes a developer container that contains toner supplied from the toner container, and a sensor that detects a concentration of the toner in the developer container. The controller changes a replenishment amount indicated in the replenishment amount information based on a predicted toner concentration value in the developer container after the toner is supplied to the developer container under control of the toner container, and a detected toner concentration value detected by the sensor.

8 Claims, 10 Drawing Sheets

IMAGE FORMING APPARATUS THAT CHANGES TONER REPLENISHMENT AMOUNT BASED ON PREDICTED AND DETECTED TONER CONCENTRATION VALUES

INCORPORATION BY REFERENCE

The present application claims priority under 35 U.S.C. § 119 to Japanese Patent Application No. 2019-138332, filed on Jul. 26, 2019. The contents of this application are incorporated herein by reference in their entirety.

BACKGROUND

The present disclosure relates to an image forming apparatus.

An electrophotographic image forming apparatus develops with toner a latent image formed on a photosensitive drum through exposure to form high-definition images. In the image forming apparatus, when toner is consumed in a development device, the development device is replenished with toner. In the image forming apparatus, a toner density is calculated for each image, and toner replenishment is performed to make up for decrease in toner concentration caused by the development to achieve uniform toner concentration distribution.

SUMMARY

An image forming apparatus according to an aspect of the present disclosure includes an attachment section, an image bearing member, a developing section, storage, and a controller. A toner container configured to contain toner is attached to the attachment section. The developing section develops a latent image on the image bearing member with toner supplied from the toner container. The storage stores replenishment amount information indicating a replenishment amount of toner supplied from the toner container to the developing section. The controller controls the toner container so that toner in the toner container is supplied to the developing section according to the replenishment amount information in the storage. The developing section includes a developer container configured to contain toner supplied from the toner container, and a sensor configured to detect a toner concentration in the developer container. The controller changes a replenishment amount indicated in the replenishment amount information based on a predicted toner concentration value after the toner is supplied to the developer container under control of the toner container, and a detected value of toner concentration detected by the sensor.

DETAILED DESCRIPTION

Figure 1:
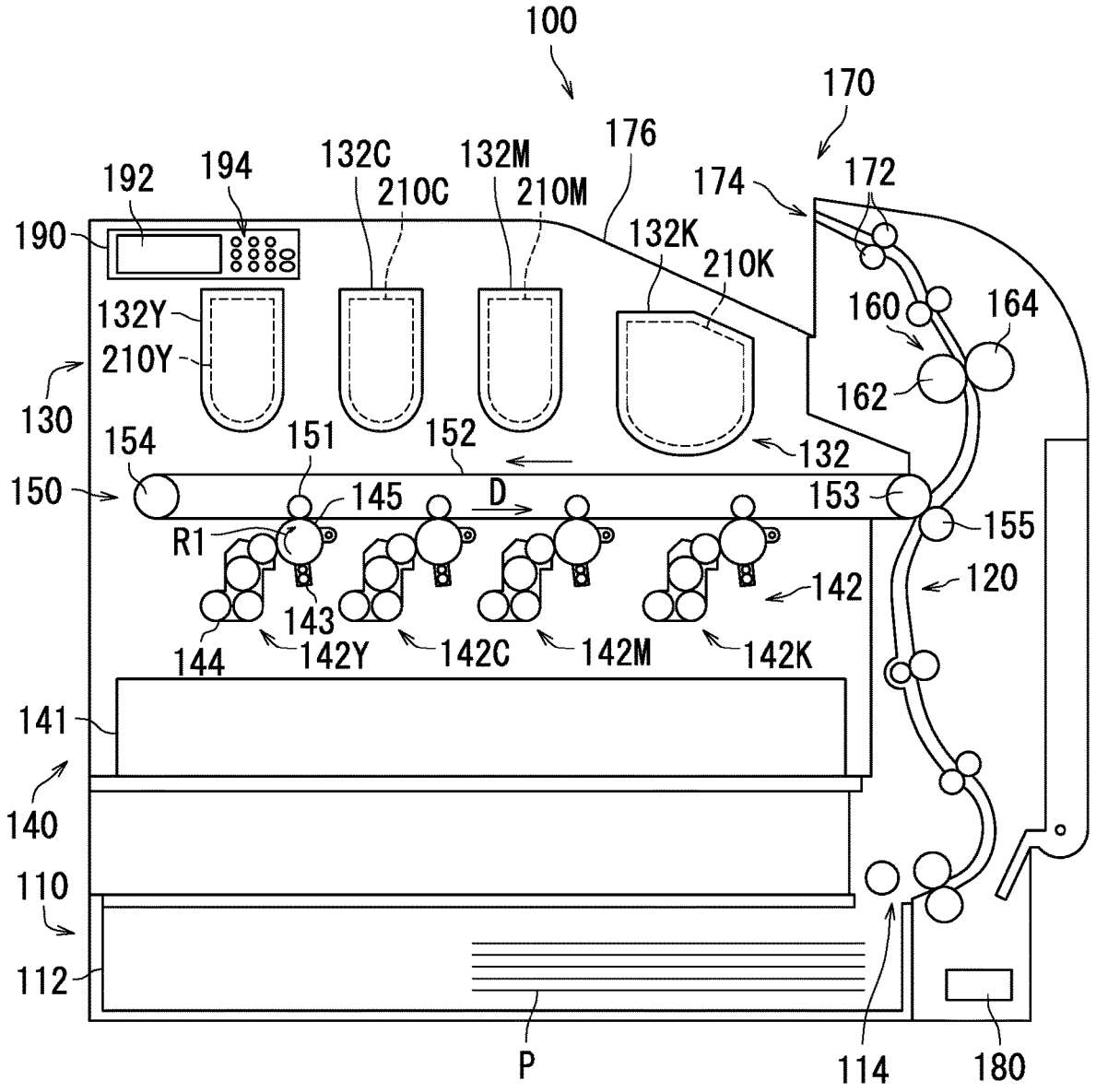
FIG. 1 is a schematic diagram illustrating an image forming apparatus according to an embodiment of the present disclosure.

The following describes an embodiment according to the present disclosure with reference to drawings. In the drawings, the same or corresponding elements are assigned the same reference signs, and descriptions thereof will not be repeated.

First, a configuration of an image forming apparatus 100 in the present embodiment will be described with reference to FIG. 1. FIG. 1 is a schematic diagram illustrating the image forming apparatus 100. The image forming apparatus 100 is an electrophotographic image forming apparatus. The image forming apparatus 100 is for example a tandem color printer.

As illustrated in FIG. 1, the image forming apparatus 100 includes a sheet feed section 110, a conveyance section 120, a toner replenishing section 130, an image forming section 140, a transfer section 150, a fixing section 160, an ejecting section 170, and a control device 180.

The sheet feed section 110 includes a sheet feed cassette 112 and a sheet feed roller 114. The sheet feed cassette 112 is capable of accommodating a plurality of sheets P. The sheet feed roller 114 feeds the sheets P accommodated in the sheet feed cassette 112 to the conveyance section 120 one by one.

The conveyance section 120 includes conveyance rollers and a guide member. The conveyance section 120 extends from the sheet feed section 110 to the ejecting section 170. The conveyance section 120 conveys a sheet P from the sheet feed section 110 to the ejecting section 170 via the image forming section 140 and the fixing section 160.

The toner replenishing section 130 replenishes the image forming section 140 with toner. The toner replenishing section 130 includes a first attachment section 132Y, a second attachment section 132C, a third attachment section 132M and a fourth attachment section 132K.

A first toner container 210Y is attached to the first attachment section 132Y. Similarly, a second toner container 210C is attached to the second attachment section 132C, a third toner container 210M is attached to the third attachment section 132M, and a fourth toner container 210K is attached to the fourth attachment section 132K. The first attachment section 132Y to the fourth attachment section 132K have the same configuration other than that different toner containers are to be attached thereto. For this reason, herein, each of the first attachment section 132Y to the fourth attachment section 132K may be generally referred to as a "attachment section 132", and each of the first toner container 210Y to the fourth toner container 210K may be generally referred to as a "toner container 210".

The first toner container 210Y, the second toner container 210C, the third toner container 210M, and the fourth toner container 210K contain different toners. In the present embodiment, the first toner container 210Y contains a yellow toner. The second toner container 210C contains a cyan toner. The third toner container 210M contains a magenta toner. The fourth toner container 210K contains a black toner.

The image forming section 140 includes an exposure section 141, a first image forming unit 142Y, a second image forming unit 142C, a third image forming unit 142M, and a fourth image forming unit 142K. The first to fourth image forming units 142Y to 142K each have a charger 143, a developing section 144, and a photosensitive drum 145. Herein, each of the first to fourth image forming units 142Y to 142K may be generally referred to as an "image forming unit 142". The photosensitive drum 145 is an example of the image bearing member.

The charger 143 and the developing section 144 are disposed on a circumferential surface of the photosensitive drum 145. In the present embodiment, the photosensitive drum 145 rotates in a direction indicated by an arrow R1 in FIG. 1 (clockwise).

The charger 143 discharges to uniformly charge the photosensitive drum 145 to a predetermined polarity. In the present embodiment, the charger 143 charges the photosensitive drum 145 to a positive polarity. The exposure section 141 irradiates the charged photosensitive drum 145 with laser light. As a result, an electrostatic latent image is formed on the surface of the photosensitive drum 145.

The developing section 144 develops the electrostatic latent image formed on the surface of the photosensitive drum 145 to form a toner image. The toner replenishing section 130 replenishes the developing section 144 with toner. The developing section 144 supplies the toner supplied from the toner replenishing section 130 to the surface of the photosensitive drum 145. As a result, a toner image is formed on the surface of the photosensitive drum 145.

In the present embodiment, the developing section 144 of the first image forming unit 142Y is connected to the first attachment section 132Y. Accordingly, the developing section 144 of the first image forming unit 142Y is replenished with the yellow toner. As a result, a yellow toner image is formed on the surface of the photosensitive drum 145 of the first image forming unit 142Y.

The developing section 144 of the second image forming unit 142C is connected to the second attachment section 132C. Accordingly, the developing section 144 of the second image forming unit 142C is replenished with the cyan toner. As a result, a cyan toner image is formed on the surface of the photosensitive drum 145 of the second image forming unit 142C.

The developing section 144 of the third image forming unit 142M is connected to the third attachment section 132M. Accordingly, the developing section 144 of the third image forming unit 142M is replenished with the magenta toner. As a result, a magenta toner image is formed on the surface of the photosensitive drum 145 of the third image forming unit 142M.

The developing section 144 of the fourth image forming unit 142K is connected to the fourth attachment section 132K. Accordingly, the developing section 144 of the fourth image forming unit 142K is replenished with the black toner. As a result, a black toner image is formed on the surface of the photosensitive drum 145 of the fourth image forming unit 142K.

The transfer section 150 transfers the toner images formed on the surfaces of the respective photosensitive drums 145 of the first to fourth image forming units 142Y to 142K in a superimposed manner to a sheet P. In the present embodiment, the transfer section 150 transfers the toner images on the sheet P in a superimposed manner by a secondary transfer method.

The transfer section 150 includes four primary transfer rollers 151, an intermediate transfer belt 152, a drive roller 153, a driven roller 154, and a secondary transfer roller 155. The intermediate transfer belt 152 is an endless belt stretched around the four primary transfer rollers 151, the drive roller 153, and the driven roller 154. The intermediate transfer belt 152 is driven by rotation of the drive roller 153. The intermediate transfer belt 152 rotates counterclockwise in FIG. 1. The driven roller 154 is rotationally driven by rotation of the intermediate transfer belt 152.

The first to fourth image forming units 142Y to 142K are disposed opposite to the lower surface of the intermediate transfer belt 152 in line with a moving direction D of the lower surface thereof. In the present embodiment, the first to fourth image forming units 142Y to 142K are disposed from upstream to downstream in the moving direction D of the lower surface of the intermediate transfer belt 152 in this order.

The primary transfer rollers 151 are disposed opposite to the respective photosensitive drums 145 with the intermediate transfer belt 152 therebetween and are pressed toward the respective photosensitive drums 145. Accordingly, the toner images formed on the surfaces of the photosensitive drums 145 are sequentially transferred to the intermediate transfer belt 152. In the present embodiment, the yellow toner image, the cyan toner image, the magenta toner image, and the black toner image are transferred to the intermediate transfer belt 152 in this order in a superimposed manner. A toner image in which a yellow toner image, a cyan toner image, a magenta toner image, and a black toner image are superimposed may be referred to below as a "superimposed toner image".

The secondary transfer roller 155 is disposed opposite to the drive roller 153 with the intermediate transfer belt 152 therebetween. The secondary transfer roller 155 is pressed toward the drive roller 153. As a result, a transfer nip is formed between the secondary transfer roller 155 and the drive roller 153. When the sheet P passes through the transfer nip, the superimposed toner image on the intermediate transfer belt 152 is transferred to the sheet P. In the present embodiment, the superimposed toner image is transferred to the sheet P so that the yellow toner image, the cyan toner image, the magenta toner image, and the black toner image are located in this order from an upper layer to a lower layer. The sheet P to which the superimposed toner image has been transferred is conveyed by the conveyance section 120 toward the fixing section 160.

The fixing section 160 includes a heating member 162 and a pressure member 164. The heating member 162 and the pressure member 164 are disposed opposite to each other to form a fixing nip. The sheet P conveyed from the image forming section 140 is pressurized while being heated at a predetermined fixing temperature when passing through the fixing nip. As a result, the superimposed toner image is fixed to the sheet P. The sheet P is conveyed by the conveyance section 120 from the fixing section 160 toward the ejecting section 170.

The ejecting section 170 includes an ejection roller pair 172, an exit port 174, and an exit tray 176. The ejection roller pair 172 conveys the sheet P to the exit tray 176 through the exit port 174. The exit port 174 is formed in an upper part of the image forming apparatus 100.

The control device 180 controls operation of each section of the image forming apparatus 100. The control device 180 controls the sheet feed section 110, the conveyance section 120, the toner replenishing section 130, the image forming section 140, the transfer section 150, the fixing section 160, and the ejecting section 170.

The image forming apparatus 100 further includes an operation section 190. The operation section 190 receives an instruction from a user. When receiving the instruction from the user, the operation section 190 transmits a signal indicating the instruction from the user to the control device 180. For example, when an instruction indicating execution of an image forming process is input, the operation section 190 transmits a signal indicating execution of the image forming process to the control device 180. As a result, the image forming apparatus 100 starts an image forming operation.

The operation section 190 includes a display section 192 and operation keys 194. The display section 192 displays various processing results. The display section 192 includes for example a liquid-crystal display device. The operation keys 194 include for example a numeric keypad and a start key.

Figure 2:
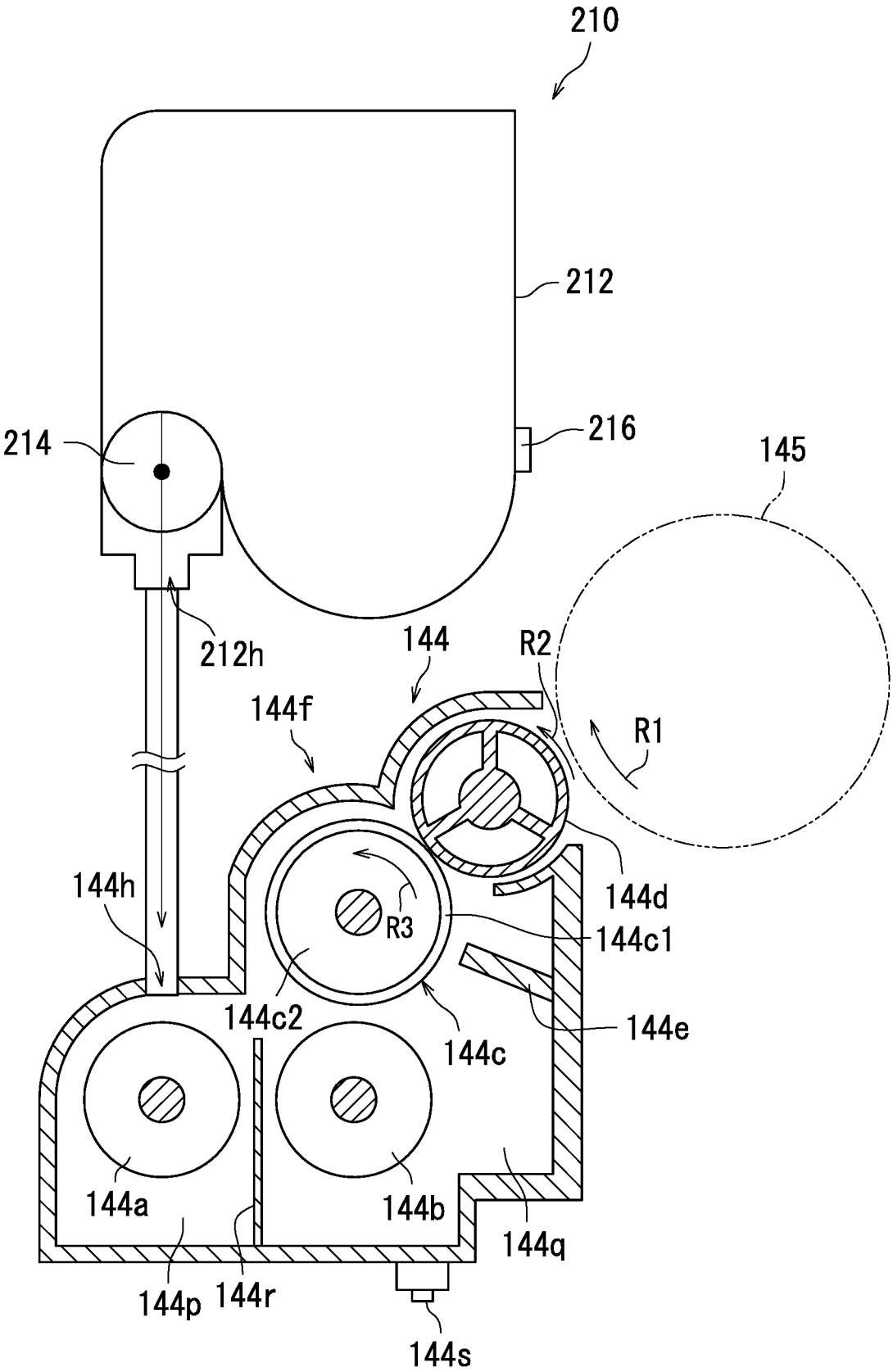
FIG. 2 is a schematic diagram illustrating a container, a developing section, and a photosensitive drum of the image forming apparatus in the present embodiment.

Next, the toner container 210, a developing section 144, and a photosensitive drum 145 in the image forming apparatus 100 will be described with reference to FIGS. 1 and 2. FIG. 2 is a schematic diagram illustrating the toner container 210, the developing section 144, and the photosensitive drum 145 of the image forming apparatus 100. The first toner container 210Y to the fourth toner container 210K have the same configuration other than that different types of toner are contained therein.

The developing section 144 includes a developer container 144*f*. A toner supply port 144*h* is formed in an upper surface of the developer container 144*f*.

As described above, the toner container 210 is attached to the attachment section 132. The toner container 210 has a container body 212 and a container screw 214. The container body 212 has a toner supply port 212*h*.

The container screw 214 is rotated by a drive mechanism of the attachment section 132 for example according to toner concentration in the developer container 144*f*. Typically, the container screw 214 is disposed in the container body 212. The container screw 214 rotates in conjunction with a gear exposed on an outer surface of the container body 212. The gear of the toner container 210 meshes with a gear of the attachment section 132. As a result, when the container screw 214 rotates as a result of rotation of the gear of the attachment section 132, toner in the container body 212 is transported to the toner supply port 212*h*. The control device 180 controls rotation of the container screw 214 via the attachment section 132. The toner transported to the toner supply port 212*h* is supplied to the developer container 144*f* through the toner supply port 144*h*.

The toner container 210 further includes storage 216. The storage 216 stores therein remaining amount information indicating a remaining amount of toner in the container body 212. The control device 180 can update the remaining amount information stored in the storage 216. For example, the control device 180 updates, after a replenishment operation, the remaining amount information in the storage 216 so as to indicate that the remaining amount of toner in the container body 212 has decreased by a replenishment amount.

In the present embodiment, the developing section 144 develops an electrostatic latent image formed on the surface of the photosensitive drum 145 by touchdown development. The developer container 144*f* is connected to the toner container 210. As a result, toner from the toner container 210 is supplied to the developer container 144*f* of the developing section 144 through the toner supply port 144*h*.

The developer container 144*f* is divided into a first stirring chamber 144*p* and a second stirring chamber 144*q* by a partition wall 144*r*. The partition wall 144*r* extends in an axial direction of a development roller 144*d*. The first stirring chamber 144*p* and the second stirring chamber 144*q* communicate with each other outside longitudinal ends of the partition wall 144*r*.

The developing section 144 includes a first stirring screw 144*a*, a second stirring screw 144*b*, a magnetic roller 144*c*, the development roller 144*d*, and a blade 144*e* inside the developer container 144*f*. Specifically, the first stirring screw 144*a* is disposed in the first stirring chamber 144*p*. A magnetic carrier is housed in the first stirring chamber 144*p*. Non-magnetic toner is supplied to the first stirring chamber 144*p* through the toner supply port 144*h*. Toner is supplied to the first stirring chamber 144*p*.

The second stirring screw 144*b* is disposed in the second stirring chamber 144*q*. A magnetic carrier is housed in the second stirring chamber 144*q*.

The development roller 144*d* is disposed opposite to the magnetic roller 144*c*. The magnetic roller 144*c* is disposed opposite to the second stirring screw 144*b*. The blade 144*e* is disposed opposite to the magnetic roller 144*c*. A toner sensor 144*s* is mounted on a bottom surface of the second stirring chamber 144*q*. The toner sensor 144*s* detects a toner concentration in the developer container 144*f*. The toner sensor 144*s* is an example of a sensor.

The toner is stirred by the first stirring screw 144*a* and the second stirring screw 144*b* to be mixed with the carrier. As a result, a two-component developer containing a carrier and a toner is produced. The two-component developer, which is an example of a developer, may be simply referred to below as a "developer".

The first stirring screw 144*a* and the second stirring screw 144*b* stir the developer to cause the developer to circulate between the first stirring chamber 144*p* and the second stirring chamber 144*q*. As a result, the toner is charged to a predetermined polarity. In the present embodiment, the toner is charged to a positive polarity.

The magnetic roller 144*c* includes a non-magnetic rotating sleeve 144*c*1 and a magnet body 144*c*2. The magnet body 144*c*2 is fixed inside the rotating sleeve 144*c*1. The magnet body 144*c*2 includes a plurality of magnetic poles. The developer is attracted to the magnetic roller 144*c* due to magnetic force of the magnet body 144*c*2. As a result, magnetic brushes are formed on the surface of the magnetic roller 144*c*.

In the present embodiment, the magnetic roller 144*c* rotates in a direction indicated by an arrow R3 in FIG. 2 (counterclockwise). The magnetic roller 144*c* rotates to convey the magnetic brushes to a position opposite to the blade 144*e*. The blade 144*e* is disposed so as to form a gap with the magnetic roller 144*c*. Accordingly, the magnetic brushes have a thickness defined by the blade 144*e*. The blade 144*e* is disposed upstream of a position where the magnetic roller 144*c* and the development roller 144*d* are opposite to each other in a rotation direction of the magnetic roller 144*c*.

A predetermined voltage is applied to the development roller 144*d* and the magnetic roller 144*c*. When a predetermined voltage is applied to make a predetermined difference in potential between the development roller 144*d* and the magnetic roller 144*c*, the toner contained in the developer moves to the development roller 144*d*. As a result, a thin layer of toner is formed on the surface of the development roller 144*d*.

The development roller 144*d* rotates in a direction indicated by an arrow R2 in FIG. 2 (counterclockwise). As a result, the thin layer of toner formed on the surface is conveyed to a position opposite to the photosensitive drum 145 and attached to the photosensitive drum 145.

For example, the toner sensor 144*s* can detect a toner concentration by detecting magnetic permeability of the toner in the developer container 144*f*. The toner sensor 144*s* measures a magnetic permeability of the developer and outputs a toner concentration. Alternatively, the toner sensor 144*s* may detect a toner concentration by measuring reflected light from the toner in the developer container 144*f*. The toner sensor 144*s* may be disposed on a side surface of the second stirring chamber 144*q*.

Figure 3:
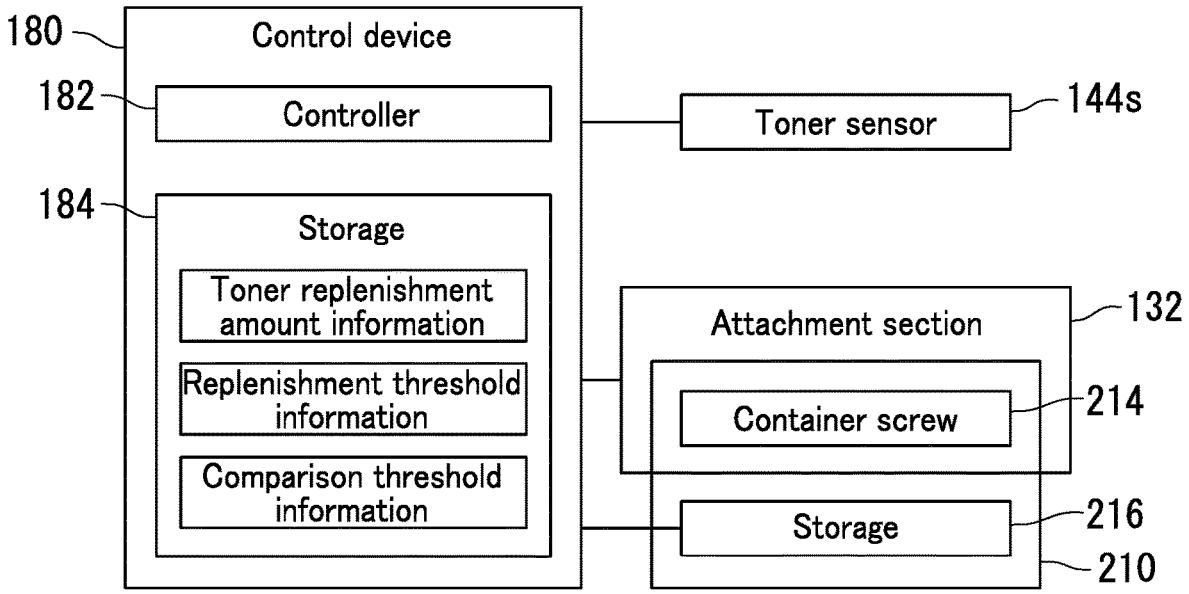
FIG. 3 is a block diagram illustrating the image forming apparatus in the present embodiment.

Next, the image forming apparatus 100 in the present embodiment will be described with reference to FIGS. 1 to 3. FIG. 3 is a block diagram illustrating the image forming apparatus 100.

The control device 180 controls operation of each section of the image forming apparatus 100. The control device 180 includes a controller 182 and storage 184. The controller 182 includes a computing element. The computing element includes a processor. In an example, the processor includes a central processing unit (CPU). The processor may include an application specific integrated circuit (ASIC).

The storage 184 includes memory such as semiconductor memory. The storage 184 may include a hard disk drive (HDD). The storage 184 stores various data therein. The storage 184 stores for example a control program therein. The controller 182 controls operation of the image forming apparatus 100 by executing a computer program stored in the storage 184.

The computer program is stored for example in a non-transitory computer-readable recording medium. Examples of the non-transitory computer-readable recording medium include read only memory (ROM), random access memory (RAM), CD-ROM, magnetic tape, magnetic disk, and optical data storage.

The toner sensor 144*s* detects a toner concentration in the developer container 144*f* as a detection value. The controller 182 receives a result of detection by the toner sensor 144*s*. The controller 182 predicts a toner concentration in the developer container 144*f* based on a detected toner concentration value. When toner is supplied from the toner container 210 to the developer container 144*f*, the toner diffuses while being advected within the developer container 144*f*, and the toner concentration in the developer container 144*f* becomes a constant value after a specific time period. The controller 182 predicts a toner concentration in the developer container 144*f*. Typically, the controller 182 predicts changes in toner concentration over time in the developer container 144*f*.

The storage 184 stores toner replenishment amount information, replenishment threshold information, and comparison threshold information therein. The toner replenishment amount information indicates an amount of toner supplied from the toner container 210 to the developing section 144 by replenishment. The amount of toner is represented in terms of weight, for example. The controller 182 controls the toner container 210 via the attachment section 132 so that the developing section 144 is replenished with toner from the toner container 210 according to the toner replenishment amount information in the storage 184. Note that the toner replenishment amount may vary depending on the state of toner in the container body 212 and the environment. For this reason, the toner replenishment amount information is changed in the image forming apparatus 100 in the present embodiment. Herein, the toner replenishment amount information may be simply referred to as replenishment amount information.

The replenishment threshold information indicates a replenishment threshold. The replenishment threshold is an index as to whether or not to perform toner replenishment. When the detected toner concentration value in the developer container 144*f* detected by the toner sensor 144*s* is smaller than the replenishment threshold, the controller 182 controls the toner container 210 via the attachment section 132 to perform toner replenishment. When the detected toner concentration value is equal to or greater than the replenishment threshold, the controller 182 does not cause toner replenishment.

The comparison threshold information indicates a comparison threshold. The comparison threshold is an index as to whether or not the toner replenishment amount is appropriate. The comparison threshold is compared with a difference between a predicted toner concentration value and the detected toner concentration value. When the difference between the predicted toner concentration value and the detected toner concentration value is smaller than the comparison threshold, the controller 182 determines that the toner replenishment amount is appropriate. When the difference between the predicted toner concentration value and the detected toner concentration value is equal to or greater than the comparison threshold, the controller 182 determines that the toner replenishment amount is inappropriate. In this case, the controller 182 updates the toner replenishment amount information to change the toner replenishment amount.

Furthermore, the controller 182 updates information in the storage 216 of the toner container 210. For example, remaining amount information indicating a remaining amount of toner in the container body 212 is stored in the storage 216. The controller 182 updates the remaining amount information in the storage 216 every time toner replenishment is performed.

Figure 4:
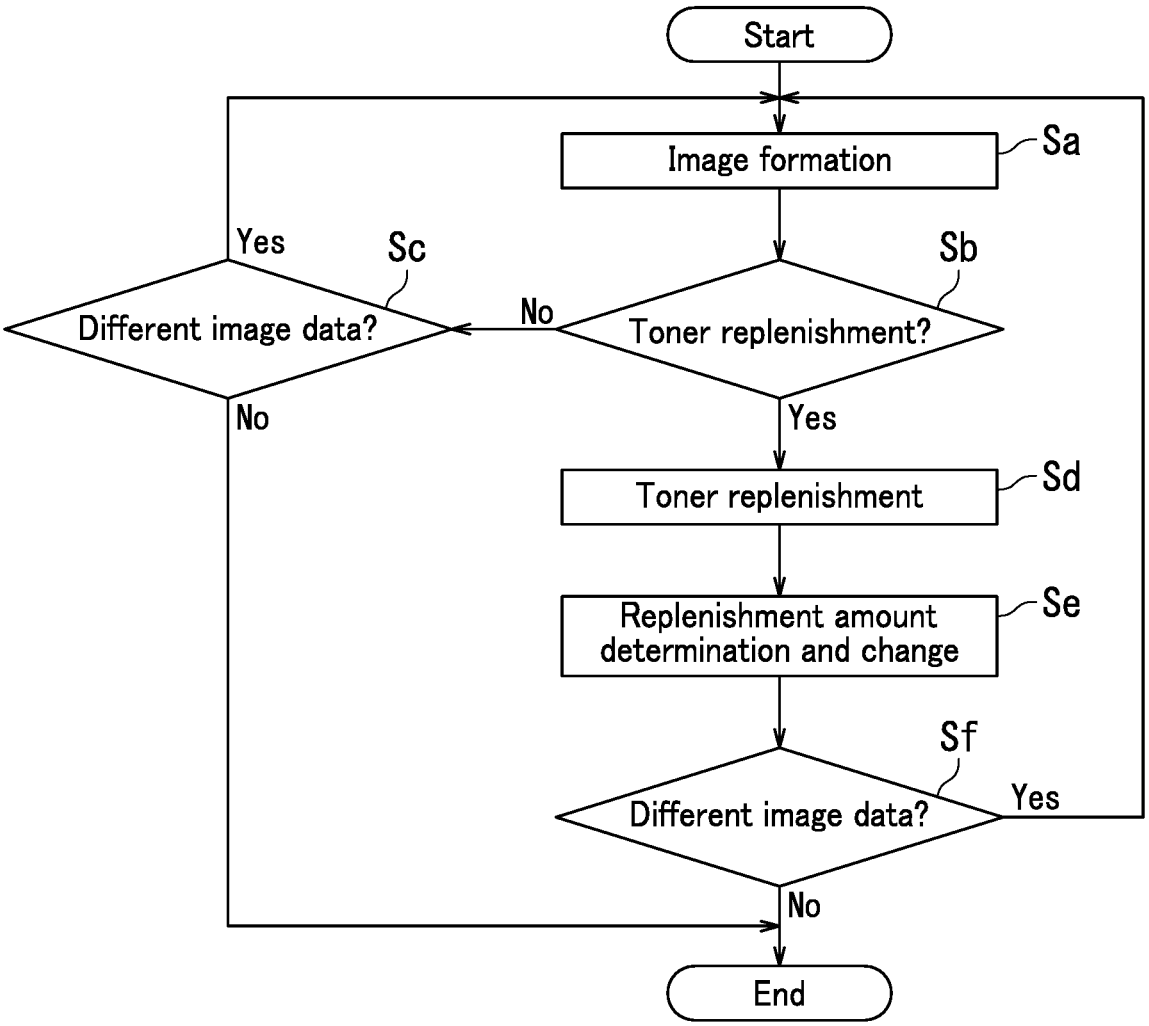
FIG. 4 is a flowchart illustrating an image forming method implemented by the image forming apparatus in the present embodiment.

Next, an image forming method implemented by the image forming apparatus 100 in the present embodiment will be described with reference to FIGS. 1 to 4. FIG. 4 is a flowchart illustrating the image forming method implemented by the image forming apparatus 100.

In Step Sa, an image is formed based on image data. The controller 182 controls the sheet feed section 110, the conveyance section 120, the toner replenishing section 130, the image forming section 140, the transfer section 150, the fixing section 160, and the ejecting section 170 to form an image on a sheet P, for example. The process proceeds to Step Sb.

In Step Sb, whether or not to perform toner replenishment is determined. The controller 182 determines whether or not toner replenishment operation is necessary based on the detected toner concentration value detected by the toner sensor 144*s*. For example, the controller 182 determines whether or not to perform toner replenishment based on whether or not the detected toner concentration value exceeds the replenishment threshold. For example, the replenishment threshold is 10% of a maximum value of toner concentration in the developer container 144*f*.

When it is determined not to perform toner replenishment (No in Step Sb), the process proceeds to Step Sc. When it is determined to perform toner replenishment (Yes in Step Sb), the process proceeds to Step Sd.

In Step Sc, whether or not there is different image data is determined. When it is determined that there is different image data (Yes in Step Sc), the process returns to Step Sa to form an image based on the different image data. When it is determined that there is no different image data (No in Step Sc), the process ends.

In Step Sd, toner replenishment is performed. The toner replenishment is performed according to the replenishment amount information in the storage 184. The controller 182 rotates the gear of the attachment section 132 to rotate the container screw 214, thereby supplying toner in the toner container 210 to the developing section 144. Toner replenishment is performed in this way. Preferably, the number of rotations of the gear of the attachment section 132 is set to an integer or a half-integer in order to keep the constant toner replenishment amount per rotation angle.

In Step Se, the toner replenishment amount is determined and changed. The controller 182 determines whether or not the toner replenishment amount indicated in the replenishment amount information in the storage 184 is appropriate.

The controller 182 acquires a predicted toner concentration value in the developer container 144*f* after toner replenishment is performed. Furthermore, the controller 182 determines whether or not the predicted toner concentration value is equivalent to the detected toner concentration value. When the predicted toner concentration value is equivalent to the detected toner concentration value, the replenishment amount information is kept as it is. When the predicted toner concentration value is different from the detected toner concentration value, the replenishment amount information is changed. The process proceeds to Step Sf.

In Step Sf, whether or not there is different image data is determined. When it is determined that there is different image data (Yes in Step Sf), the process returns to Step Sa to form an image based on the different image data. When it is determined that there is no different image data (No in Step Sf), the process ends. In the present embodiment, an image is formed while toner replenishment is performed as described above. In the present embodiment, based on the result of toner replenishment, it is determined whether or not toner replenishment according to the replenishment amount information is equivalent to actually performed toner replenishment. When toner replenishment according to the replenishment amount information is not equivalent to actually performed toner replenishment, the toner replenishment amount information is updated so as to change the toner replenishment amount in the storage 184.

Figure 5:
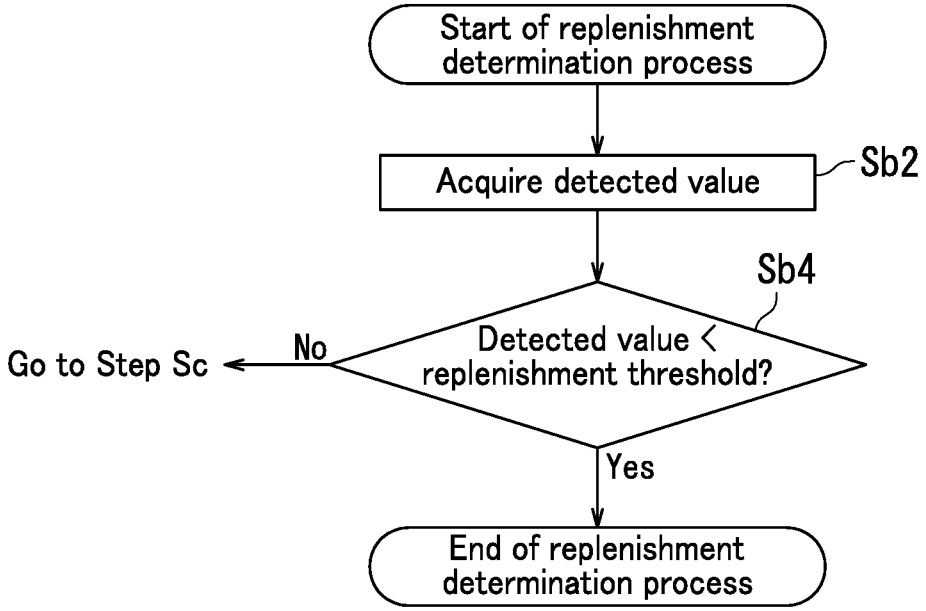
FIG. 5 is a flowchart illustrating a replenishment determination process in the image forming method implemented by the image forming apparatus in the present embodiment.

Next, a replenishment determination process performed in the image forming apparatus 100 in the present embodiment will be described with reference to FIG. 5. FIG. 5 is a flowchart illustrating the replenishment determination process performed by the image forming apparatus 100.

In Step Sb2, after an image is formed, the toner sensor 144*s* detects a toner concentration in the developer container 144*f* as a detection value. The process proceeds to Step Sb4.

In Step Sb4, it is determined whether or not the detected toner concentration value is smaller than the replenishment threshold. When it is determined that the detected toner concentration value is equal to or greater than the replenishment threshold (No in Step Sb4), the process proceeds to Step Sc. In this case, toner replenishment is not performed.

When it is determined that the detected toner concentration value is smaller than the replenishment threshold (Yes in Step Sb4), the controller 182 determines to perform toner replenishment. As a result, the replenishment determination process ends, and the image forming process proceeds to Step Sd (FIG. 4). As described above, whether or not to perform toner replenishment is determined based on a result of comparison between the detected value by the toner sensor 144*s* and the replenishment threshold.

In the above description with reference to FIG. 5, when the toner detection value is equal to the replenishment threshold, the process proceeds to Step Sc after determination not to perform toner replenishment. However, the present embodiment is not limited thereto. Even when the detected value is equal to the replenishment threshold, determination may be made to perform toner replenishment.

Figure 6:
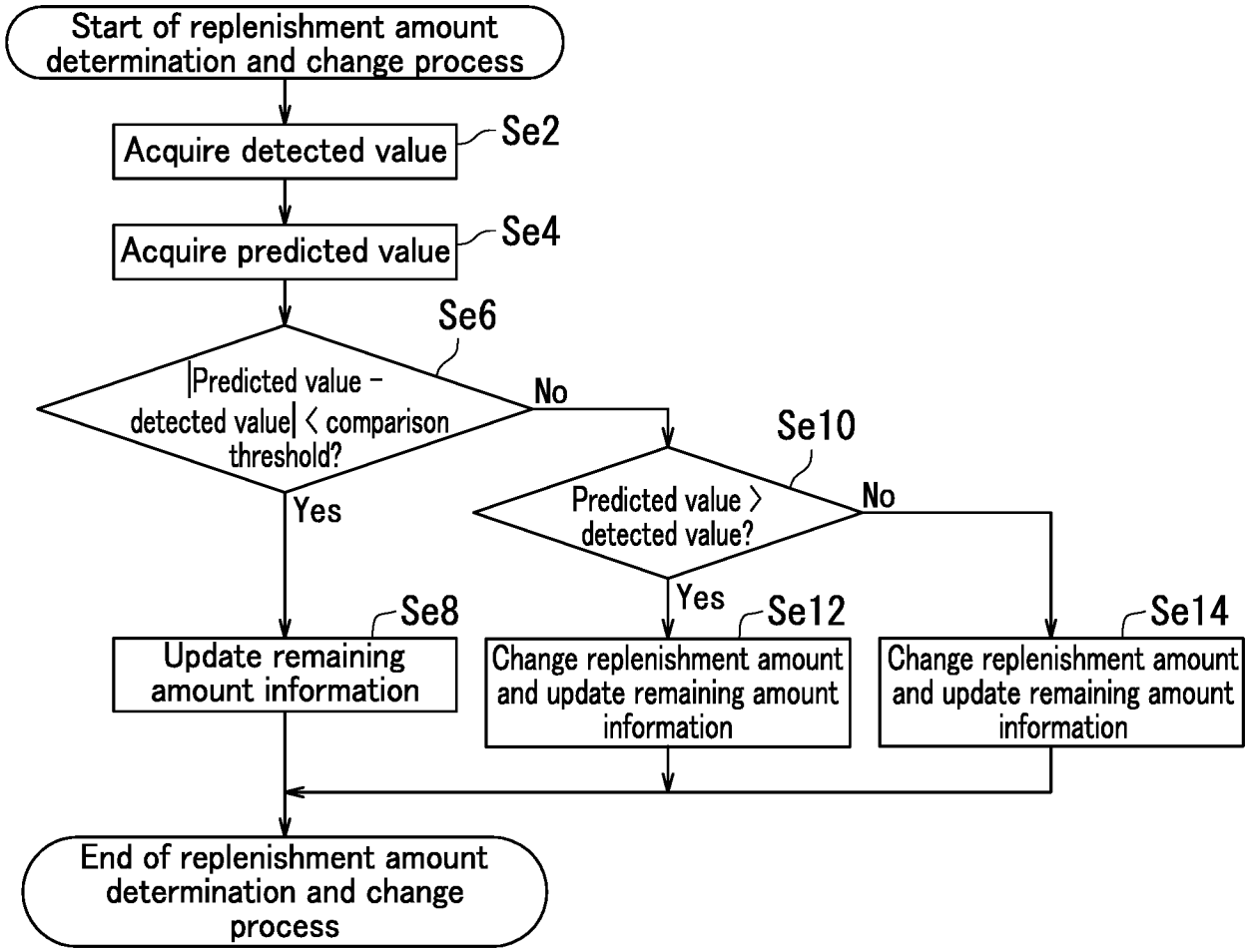
FIG. 6 is a flowchart illustrating a replenishment amount determination and change process in the image forming method implemented by the image forming apparatus in the present embodiment.

Next, a replenishment amount determination and change process performed by the image forming apparatus 100 in the present embodiment will be described with reference to FIGS. 1 to 6. FIG. 6 is a flowchart illustrating a replenishment amount determination and change process performed by the image forming apparatus 100. As described above with reference to FIG. 4, the replenishment amount determination and change process is performed after toner replenishment is performed.

In Step Se2, after toner replenishment is performed, the toner sensor 144*s* detects a toner concentration in the developer container 144*f* as a detection value. The process proceeds to Step Se4.

In Step Se4, the controller 182 predicts a toner concentration in the developer container 144*f* according to the toner replenishment amount indicated in the toner replenishment amount information. Further, the controller 182 acquires a predicted toner concentration value corresponding to the detected toner concentration value.

For example, the controller 182 may predict a toner concentration in the developer container 144*f* by using the following advection diffusion equation.

$$\frac{\partial \varphi}{\partial t} = D\frac{\partial^2 \varphi}{\partial x^2} - C\frac{\partial \varphi}{\partial x}$$

Here, D represents a diffusion coefficient ($mm^2/s$) and C represents an advection coefficient (mm/s). The controller 182 predicts a toner concentration according to a location and a time in the developer container 144*f* as a predicted toner concentration value. Typically, when toner is supplied from the toner container 210 to the developing section 144, toner concentration in the developer container 144*f* exhibits a peak. When the toner is advected and diffuses in the developer container 144*f*, the peak of toner concentration is also advected and the peak value decreases. After a specific time period, the toner has sufficiently diffused and the toner concentration becomes constant. The controller 182 may obtain a peak toner concentration at the location where the toner sensor 144*s* is disposed as a predicted toner concentration value.

In Step Se6, it is determined whether or not the difference between the predicted value and the detected toner concentration value is smaller than the comparison threshold. When it is determined that the difference between the predicted value and the detected value is smaller than the comparison threshold (Yes in Step Se6), the process proceeds to Step Se8. When it is determined that the difference between the predicted value and the detected value is equal to or greater than the comparison threshold (No in Step Se6), the process proceeds to Step Se10.

In step Se8, the controller 182 updates the remaining amount information of the toner container 210 based on the toner replenishment amount. When the difference between the predicted value and the detected value is smaller than the comparison threshold, it is determined that the toner replenishment amount indicated in the replenishment amount information in the storage 184 is appropriate. Thereafter, the replenishment amount determination and change process ends.

In Step Se10, it is determined whether or not the predicted toner concentration value is greater than the detected toner concentration value. The controller 182 compares the predicted value and the detected toner concentration value and determines whether or not the predicted toner concentration value is greater than the detected toner concentration value.

When it is determined that the predicted toner concentration value is greater than the detected toner concentration value (Yes in Step Se10), the process proceeds to Step Se12. When it is determined that the predicted toner concentration value is equal to or smaller than the detected toner concentration value (No in Step Se10), the process proceeds to Step Se14.

In Step Se12, the toner replenishment amount is changed. The controller 182 changes the toner replenishment amount in the storage 184 so as to match the detected value. Specifically, the controller 182 updates the replenishment amount information in the storage 184 so that the toner replenishment amount decreases.

For example, in a case where the toner replenishment amount information stored in the storage 184 indicates a toner replenishment amount of 30 g before replenishment operation but a toner replenishment amount acquired from a result detected by the toner sensor 144*s* is 20 g, the controller 182 updates the replenishment amount information so that the toner replenishment amount indicated in the replenishment amount information decreases. In this case, the toner replenishment amount indicated in the replenishment amount information is preferably changed to a value between the toner replenishment amount stored before the toner replenishment and the toner replenishment amount acquired from the actual detection result. This is because the detection result may be an extreme value. For example, the toner replenishment amount indicated in the replenishment amount information is preferably changed to 25 g. However, the toner replenishment amount indicated in the replenishment amount information may be changed from 30 g to 20 g.

The controller 182 also updates the remaining amount information in the storage 216 based on the changed toner replenishment amount. Thereafter, the replenishment amount determination and change process ends. Since the toner replenishment amount has been changed in Step Se12, when toner replenishment is performed under the same conditions in the future, the controller 182 performs toner replenishment according to the changed toner replenishment amount. As a result, toner replenishment can be detected with high accuracy. Also, the remaining amount information in the storage 216 indicates a highly accurate remaining amount in the toner container 210.

In Step Se12, it has been determined that the predicted toner concentration value is greater than the detected toner concentration value. Accordingly, the controller 182 may control the toner container 210 to further perform toner replenishment until the detected toner concentration value reaches the predicted toner concentration value.

In Step Se14, the toner replenishment amount is changed. The controller 182 changes the toner replenishment amount in the storage 184 so as to match the detected value. Specifically, the controller 182 updates the replenishment amount information in the storage 184 so that the toner replenishment amount increases.

For example, in a case where the toner replenishment amount information stored in the storage 184 indicates a toner replenishment amount of 30 g before replenishment operation but a toner replenishment amount acquired from a result detected by the toner sensor 144*s* is 40 g, the controller 182 updates the replenishment amount information so that the toner replenishment amount indicated in the replenishment amount information increases. In this case, the toner replenishment amount indicated in the replenishment amount information is preferably changed to a value between the toner replenishment amount stored before the toner replenishment and the toner replenishment amount acquired from the actual detection result. This is because a detected toner replenishment amount may be an extreme value. For example, the toner replenishment amount indicated in the replenishment amount information is preferably changed to 35 g. However, the toner replenishment amount indicated in the replenishment amount information may be changed from 30 g to 40 g.

The controller 182 also updates the remaining amount information in the storage 216 based on the changed toner replenishment amount. Thereafter, the replenishment amount determination and change process ends. Since the toner replenishment amount has been changed in Step Se14, when toner replenishment is performed under the same conditions in the future, the controller 182 performs toner replenishment according to the changed toner replenishment amount. As a result, toner replenishment can be detected with high accuracy. Also, the remaining amount information in the storage 216 indicates a highly accurate remaining amount in the toner container 210.

The replenishment amount determination and change process is executed as described above. In the present embodiment, when comparison in toner concentration between the predicted toner concentration value and the detected toner concentration value results in determination that the toner replenishment amount in the storage 184 is inappropriate, the controller 182 changes the toner replenishment amount in the storage 184 so as to match the detected value. Since the toner replenishment amount is changed so as to match the detection value after actual replenishment operation, the toner replenishment can be detected with high accuracy.

In the above description with reference to FIG. 6, when the difference between the predicted value and the detected toner concentration value is equal to the comparison threshold, the remaining amount information in the storage 216 and the replenishment amount information in the storage 184 are updated. However, the present embodiment is not limited thereto. When the difference between the predicted toner concentration value and the detected toner concentration value is equal to the comparison threshold, the remaining amount information in the storage 216 may be updated without updating the replenishment amount information in the storage 184.

Furthermore, in the above description with reference to FIG. 6, the toner replenishment amount is changed in each of Step Se12 and Step Se14. However, the present embodiment is not limited thereto. When the predicted value is smaller than the detected value, that is, when replenishment of the developer container 144*f* with a relatively large amount of toner is performed, the detected value of the toner sensor 144*s* may not accurately represent the toner concentration in the developer container 144*f*. When the developing section 144 contains a two-component developer containing a toner and a carrier, if replenishment toner is not thoroughly mixed with the carrier, a detected value of the toner sensor 144*s* immediately after the replenishment may be different from an actual toner concentration in the developer container 144*f*.

Figure 7:
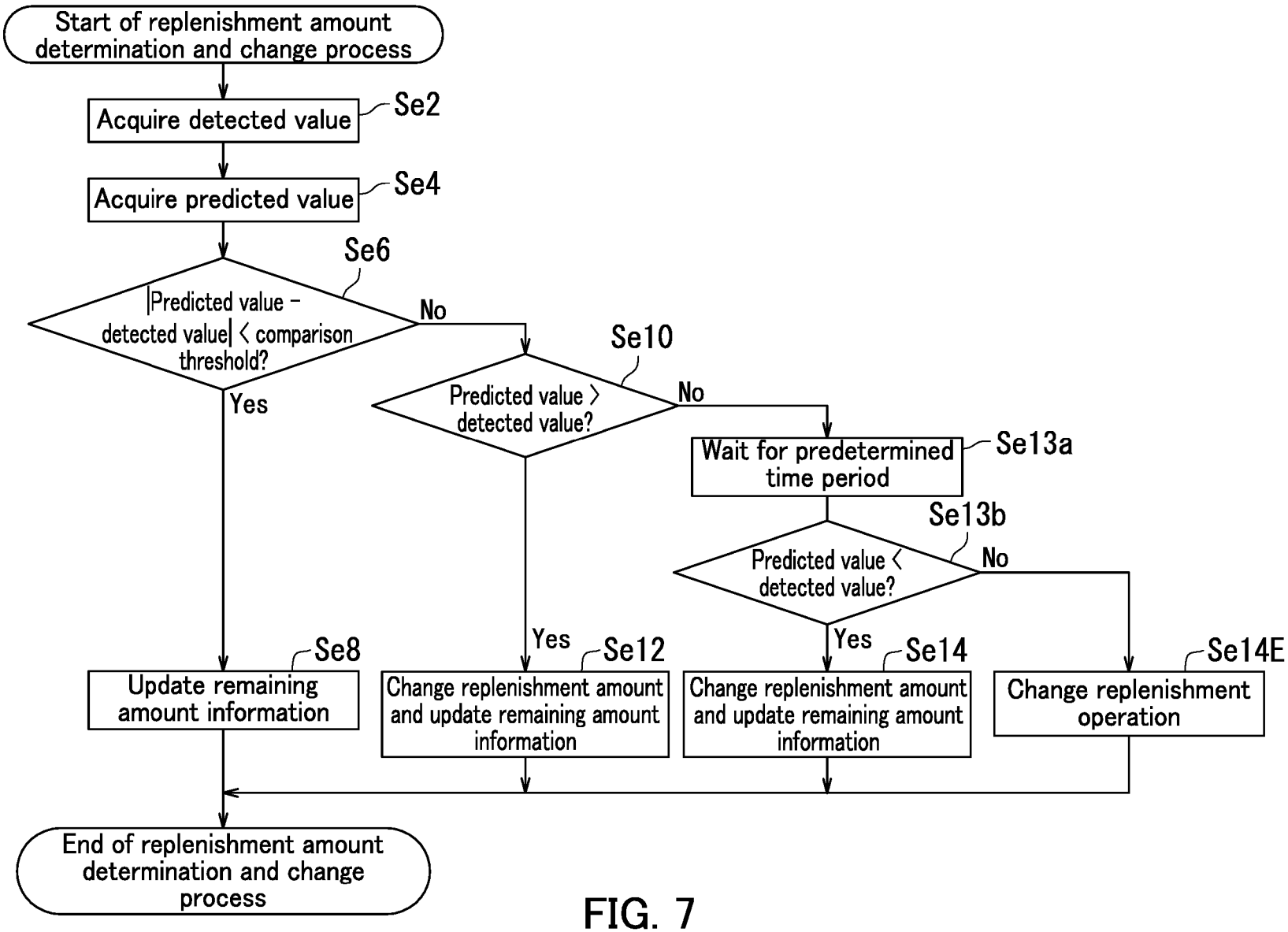
FIG. 7 is a flowchart illustrating a replenishment amount determination and change process in the image forming method by the image forming apparatus in the present embodiment.

Next, a replenishment amount determination and change process performed by the image forming apparatus 100 in the present embodiment will be described with reference to FIG. 7. FIG. 7 is a flowchart illustrating a replenishment amount determination and change process performed by the image forming apparatus 100. The flowchart in FIG. 7 is the same as the flowchart in FIG. 6 except for further including Step Se13*a*, Step Se13*b*, and Step Se14E. For this reason, overlapping descriptions will not be repeated for avoiding redundancy. Here, Steps Se2, Se4, Se6, Se8, Se10, Se12, and Se14 are the same as those in FIG. 6.

In Step Se10, it is determined whether or not the predicted value is greater than the detected value. The controller 182 compares the predicted value and the detected value to determine whether or not the predicted value is greater than the detected value. When it is determined that the predicted value is greater than the detected value (Yes in Step Se10), the process proceeds to Step Se12. When it is determined that the predicted value is equal to or smaller than the detected value (No in Step Se10), the process proceeds to Step Se13*a*.

In Step Se13*a*, the controller 182 is in an idle state for a predetermined time period. For example, the controller 182 is in an idle state until a time period required for the toner to circulate in the developer container 144*f* two rotations according to an advection rate elapses. When toner replenishment is performed, toner in the developer container 144*f* exhibits a sharp concentration peak at the timing of the replenishment, and the toner concentration peak moves in the developer container 144*f* with advection of toner. Thereafter, the toner diffuses while being advected. When a time period that allows the toner to circulate within the developer container 144*f* two rotations approximately elapses, the toner concentration peak disappears.

In a configuration in which the toner sensor 144*s* is a magnetic permeability sensor and the developing section 144 contains a two-component developer, even if the developer container 144*f* is replenished with toner, the magnetic permeability of the toner may not sufficiently converge immediately after the replenishment. However, after a specific time period elapses, the magnetic permeability of supplied toner converges, so that the detected toner concentration value detected by the toner sensor 144*s* increases. Thereafter, the process proceeds to Step Se13*b*.

In Step Se13*b*, it is determined whether or not the predicted value is smaller than the detected value. The controller 182 compares the predicted toner concentration value and the detected toner concentration value to determine whether or not the predicted value is smaller than the detected value. When it is determined that the predicted toner concentration value is smaller than the detected toner concentration value (Yes in Step Se13*b*), the process proceeds to Step Se14. When it is determined that the predicted toner concentration value is equal to or greater than the detected toner concentration value (No in Step Se13*b*), the process proceeds to Step Se14E.

In Step Se14, the toner replenishment amount is changed. The controller 182 changes the toner replenishment amount in the storage 184 so as to match the detected value. Specifically, the controller 182 updates the replenishment amount information in the storage 184 so that the toner replenishment amount increases. The controller 182 also updates the remaining amount information in the storage 216 based on the changed toner replenishment amount. Thereafter, the replenishment amount determination and change process ends.

In Step Se14E, the toner replenishment operation is changed. The controller 182 changes the replenishment operation so that diffusion of toner supplied to the developer container 144*f* is facilitated in the developer container 144*f*. For example, the controller 182 changes the replenishment operation so that the replenishment operation is intermittently performed. For example, the controller 182 changes the replenishment operation from an initial replenishment operation in which the container screw 214 is continuously rotated three times to a replenishment operation in which the container screw 214 is rotated three times in total including a combination of one rotation of the container screw 214 and a waiting time. As a result, when toner replenishment is performed under the same conditions in the future, the controller 182 performs toner replenishment according to the changed toner replenishment operation.

However, in Step Se14E, the toner replenishment amount is not changed in the storage 184. Also, the remaining amount information in the storage 216 is updated based on the initial toner replenishment amount. The controller 182 updates the remaining amount information in the storage 216 based on the initial toner replenishment amount. Thereafter, the replenishment amount determination and change process ends.

In the above description with reference to FIGS. 4 to 7, the toner replenishment amount in the storage 184 is changed. However, the present embodiment is not limited thereto. The toner replenishment amount per rotation of the container screw 214 (may be referred to below as the "rotation replenishment amount") may be changed based on the predicted value and the detected value.

Figure 8:
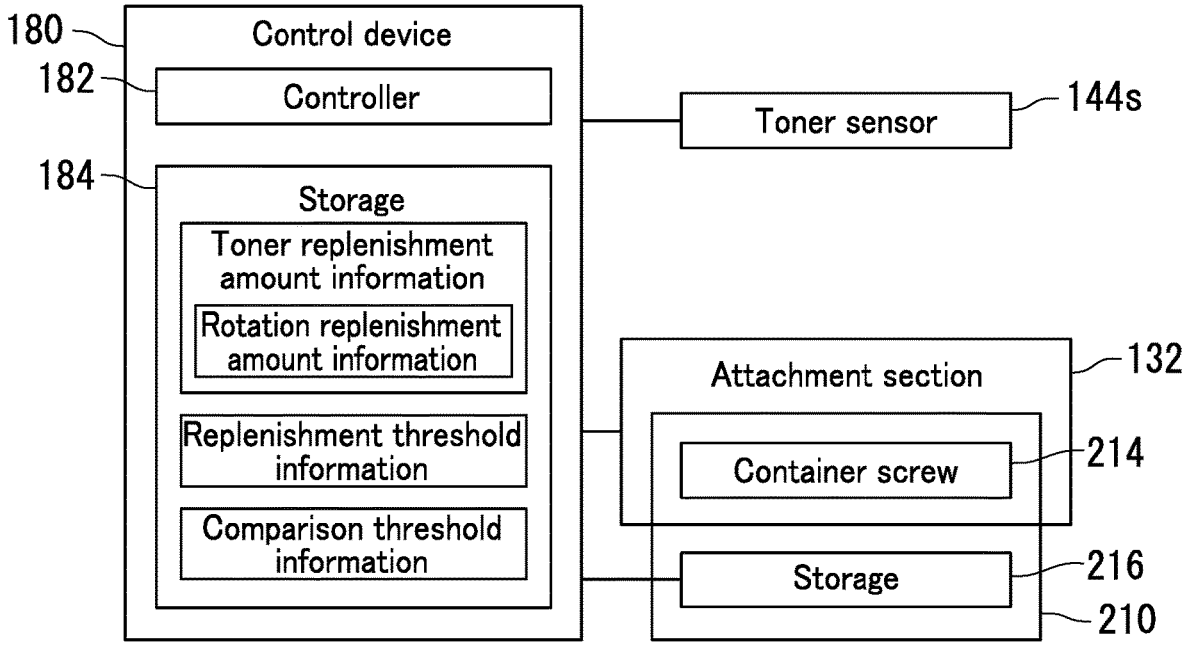
FIG. 8 is a block diagram illustrating the image forming apparatus in the present embodiment.
Figure 9:
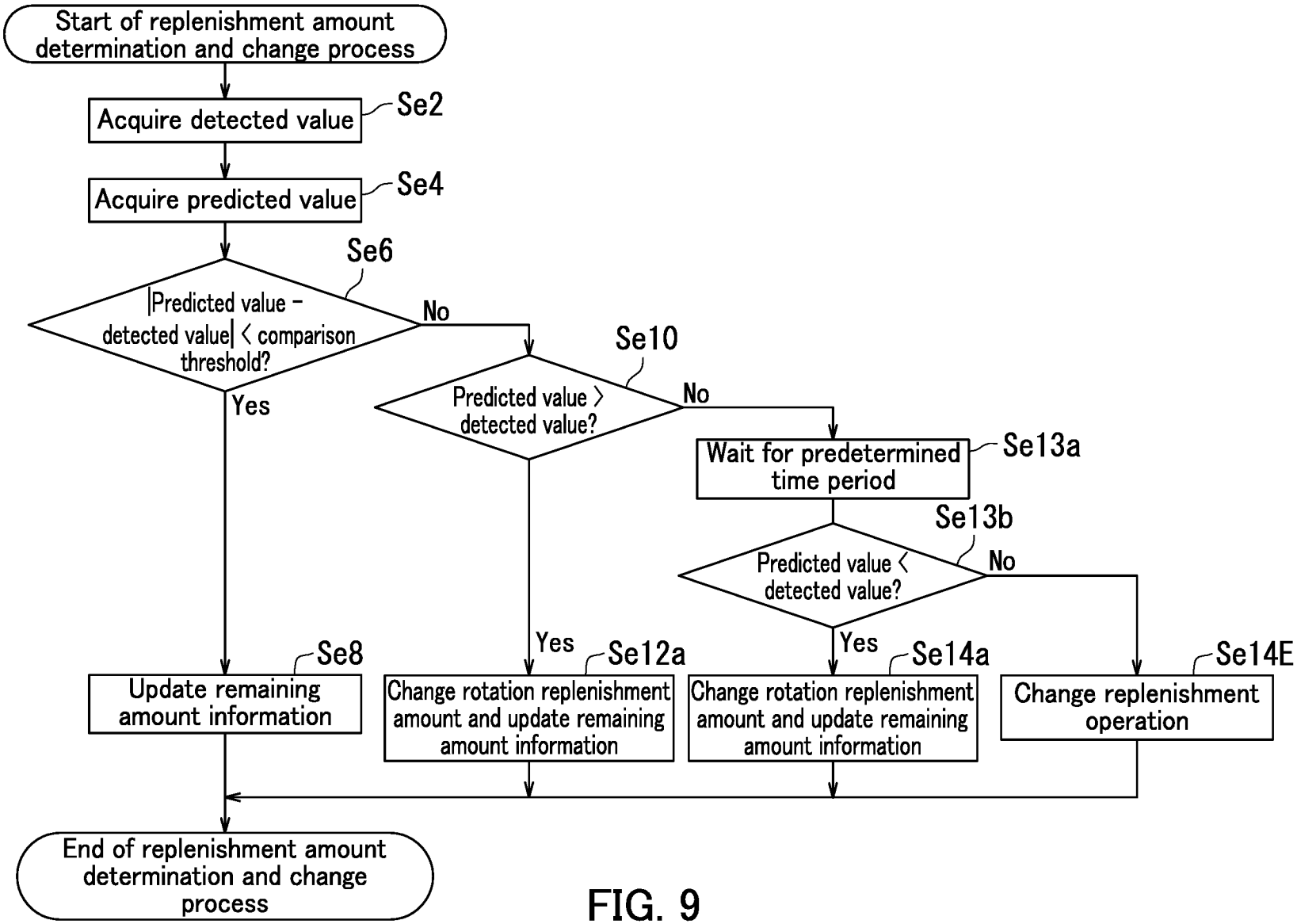
FIG. 9 is a flowchart illustrating a replenishment amount determination and change process in the image forming method by the image forming apparatus in the present embodiment.

Next, an image forming apparatus 100 in the present embodiment will be described with reference to FIGS. 8 and 9. FIG. 8 is a block diagram illustrating an image forming apparatus 100. The block diagram in FIG. 8 is the same as the block diagram in FIG. 3 other than that the storage 184 stores rotation replenishment amount information therein. For this reason, overlapping descriptions will not be repeated in order to avoid redundancy.

The toner replenishment amount information in the storage 184 includes rotation replenishment amount information. The rotation replenishment amount information indicates an amount of toner supplied from the container body 212 to the developing section 144 per one rotation of the container screw 214. Note that the rotation replenishment amount may vary depending on the state of toner in the container body 212 and the environment. The rotation replenishment amount can be obtained by dividing the toner replenishment amount by the number of rotations of the container screw 214. The rotation replenishment amount in the storage 184 is changed in the replenishment amount determination and change process.

Next, a replenishment amount determination and change process in the image forming apparatus 100 in the present embodiment will be described with reference to FIG. 9. FIG. 9 is a flowchart illustrating the replenishment amount determination and change process in the image forming apparatus 100. The flowchart in FIG. 9 is the same as the flowchart in FIG. 7 other than that Step Se12*a* and Step Se14*a* are changed. For this reason, overlapping descriptions will not be repeated in order to avoid redundancy. Steps Se2, Se4, Se6, Se8, Se10, Se13*a*, Se13*b*, and Se14E are the same as those in FIG. 7 other than that the detected value and the predicted value are each changed to the rotation replenishment amount.

In Step Se10, it is determined whether or not the predicted value is greater than the detected value. The controller 182 compares the predicted value and the detected value to determine whether or not the predicted value is greater than the detected value. When it is determined that the predicted value is greater than the detected value (Yes in Step Se10), the process proceeds to Step Se12*a*. When it is determined that the predicted value is equal to or smaller than the detected value (No in Step Se10), the process proceeds to Step Se13*a*.

In Step Se12*a*, the rotation replenishment amount is changed. The controller 182 changes the rotation replenishment amount in the storage 184 so as to match the detected value. Specifically, the controller 182 updates the rotation replenishment amount information in the storage 184 so that the rotation replenishment amount decreases.

For example, in a case where the rotation replenishment amount information stored in the storage 184 indicates a rotation replenishment amount of 30 mg before replenishment operation but a toner replenishment amount acquired from a result of detection by the toner sensor 144*s* is 20 mg, the controller 182 updates the rotation replenishment amount information so that the rotation replenishment amount indicated in the rotation replenishment amount information decreases. In this case, the rotation replenishment amount indicated in the rotation replenishment amount information is preferably changed to a value between the rotation replenishment amount stored before the toner replenishment and the rotation replenishment amount acquired from the actual detection result. This is because a detected toner replenishment amount may be an extreme value. For example, the rotation replenishment amount indicated in the rotation replenishment amount information is preferably changed to 25 mg. However, the rotation replenishment amount indicated in the rotation replenishment amount information may be changed from 30 mg to 20 mg.

The controller 182 also updates the remaining amount information in the storage 216 based on the changed rotation replenishment amount. Thereafter, the replenishment amount determination and change process ends. Since the rotation replenishment amount has been changed in Step Se12*a*, when toner replenishment is performed under the same conditions in the future, the controller 182 performs toner replenishment according to the changed rotation replenishment amount.

In Step Se13*b*, it is determined whether or not the predicted value is smaller than the detected value. The controller 182 compares the predicted value and the detected value to determine whether or not the predicted value is smaller than the detected value. When it is determined that the predicted value is smaller than the detected value (Yes in Step Se13*b*), the process proceeds to Step Se14*a*. When it is determined that the predicted value is equal to or greater than the detected value (No in Step Se13*b*), the process proceeds to Step Se14E.

In Step Se14*a*, the rotation replenishment amount is changed. The controller 182 changes the rotation replenishment amount in the storage 184 so as to match the detected value. Specifically, the controller 182 updates the rotation replenishment amount information in the storage 184 so that the rotation replenishment amount increases.

For example, in a case where the rotation replenishment amount information stored in the storage 184 indicates a rotation replenishment amount of 30 mg before replenishment operation but a toner replenishment amount acquired from a detection result of the toner sensor 144*s* is 40 mg, the controller 182 updates the rotation replenishment amount information so that the rotation replenishment amount indicated in the rotation replenishment amount information increases. In this case, the rotation replenishment amount indicated in the rotation replenishment amount information is preferably changed to a value between the rotation replenishment amount stored before the toner replenishment and the rotation replenishment amount acquired from the actual detection result. This is because the detection result may be an extreme value. For example, the rotation replenishment amount indicated in the rotation replenishment amount information is preferably changed to 35 mg. However, the toner replenishment amount indicated in the replenishment amount information may be changed from 30 mg to 40 mg.

The controller 182 also updates the remaining amount information in the storage 216 based on the changed rotation replenishment amount. Thereafter, the replenishment amount determination and change process ends. Since the rotation replenishment amount has been changed in Step Se14*a*, when toner replenishment is performed under the same conditions in the future, the controller 182 performs toner replenishment according to the changed rotation replenishment amount.

In the above description with reference to FIGS. 1 to 9, either or both of the toner replenishment amount and the rotation replenishment amount are set regardless of the environment. However, the present embodiment is not limited thereto. Either or both of the toner replenishment amount and the rotation replenishment amount may be set depending on the environment.

Figure 10:
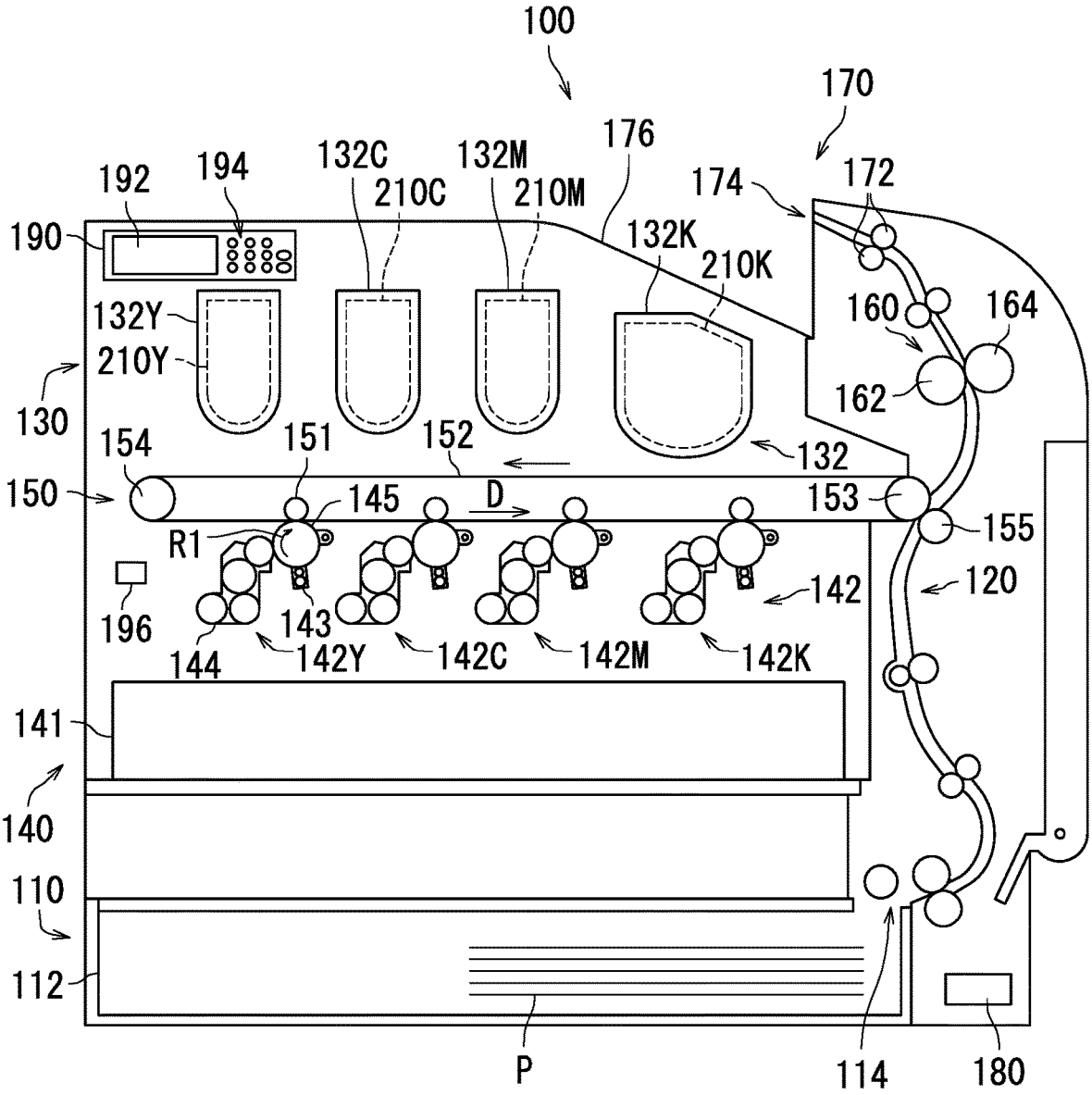
FIG. 10 is a schematic diagram illustrating an image forming apparatus according to the present embodiment.

Next, an image forming apparatus 100 in the present embodiment will be described with reference to FIGS. 1 to 3 and 10. FIG. 10 is a schematic diagram illustrating an image forming apparatus 100. The image forming apparatus 100 in FIG. 10 has the same configuration as the image forming apparatus 100 in FIG. 1 except for further including a hygrometer 196. For this reason, overlapping descriptions will not be repeated in order to avoid redundancy.

The image forming apparatus 100 in the present embodiment further includes a hygrometer 196. The hygrometer 196 measures a humidity. The controller 182 stores toner replenishment amount information indicating different toner replenishment amounts depending on the humidity measured by the hygrometer 196.

For example, the controller 182 uses different toner replenishment amount information depending on the humidity. For example, the storage 184 stores therein replenishment amount information indicating a high-humidity toner replenishment amount used at high humidity, replenishment amount information indicating a medium-humidity toner replenishment amount used at medium humidity, and replenishment amount information indicating a low-humidity toner replenishment amount used at low humidity. The controller 182 uses the replenishment amount information indicating the high-humidity toner replenishment amount at high humidity, uses the replenishment amount information indicating the medium-humidity toner replenishment amount at medium humidity, and uses the replenishment amount information indicating low-humidity toner replenishment amount at low humidity. For example, when the (relative) humidity is 0% or higher and less than 60%, the replenishment amount information indicating the low-humidity toner replenishment amount is used. When the humidity is 60% or higher and less than 90%, the replenishment amount information indicating the medium-humidity toner replenishment amount is used. When the humidity is 90% or higher, the replenishment amount information indicating the high-humidity toner replenishment amount is used.

In the image forming apparatus 100 illustrated in FIG. 10, the hygrometer 196 measures a humidity, but the present embodiment is not limited thereto. The image forming apparatus 100 may receive information indicating a humidity from an external communication device via a communication section. Alternatively, the image forming apparatus 100 may receive information indicating the weather (sunny, cloudy, rainy) from an external communication device via the communication section and set different toner replenishment amount information based on the weather.

Further, in the above description, the humidity is set in three levels of high humidity, medium humidity, and low humidity, but the present embodiment is not limited thereto. The humidity may be set in two levels or in four or more levels.

Further, in the above description, the toner replenishment amount information is set according to the humidity as an example of environmental conditions, but the present embodiment is not limited thereto. The toner replenishment amount information may be set according to the temperature. Alternatively, the toner replenishment amount information may be set according to the humidity and the temperature.

Hereinbefore, an embodiment of the present disclosure has been described with reference to the drawings. However, the present disclosure is not limited to the above embodiment and may be implemented in various different forms that do not deviate from the essence of the present disclosure. The elements of configuration disclosed in the above embodiment examples may be appropriately combined to form variations of the disclosure. For example, some elements of configuration may be omitted from all the elements described in the embodiment. The elements of configuration disclosed in different embodiment examples may be appropriately combined. The drawings schematically illustrate elements of configuration in order to facilitate understanding, and properties such as thickness, length, number, and interval of elements of configuration illustrated in the drawings may differ from actual properties thereof in order to facilitate preparation of the drawings. Aspects of the elements of configuration described in the above embodiment examples such as material, shape, and dimension are merely examples and not particular limitations. The elements of configuration may be variously altered within a scope not substantially departing from the effects of the present disclosure.

What is claimed is:

1. An image forming apparatus comprising:

an attachment section to which a toner container that contains toner is attached;

an image bearing member;

a developing section configured to develop a latent image on the image bearing member with toner supplied from the toner container;

storage that stores therein replenishment amount information indicating a replenishment amount of toner supplied from the toner container to the developing section; and a controller configured to control the toner container so that toner in the toner container is supplied to the developing section according to the replenishment amount information in the storage, wherein the developing section includes:

a developer container configured to contain toner supplied from the toner container; and a sensor configured to detect a concentration of the toner in the developer container, and the controller changes the replenishment amount indicated in the replenishment amount information based on a predicted toner concentration value and a detected toner concentration value, the predicted toner concentration value being a predicted value of a toner concentration in the developer container after the toner is supplied to the developer container under control of the toner container, the detected toner concentration value being a value detected by the sensor.

2. The image forming apparatus according to claim 1, wherein when the predicted toner concentration value is greater than the detected toner concentration value, the controller updates the replenishment amount information so that the replenishment amount indicated in the replenishment amount information decreases.

3. The image forming apparatus according to claim 1, wherein when the predicted toner concentration value is smaller than the detected toner concentration value, the controller updates the replenishment amount information so that the replenishment amount indicated in the replenishment amount information increases.

4. The image forming apparatus according to claim 3, wherein when it is determined that the predicted toner concentration value is smaller than the detected toner concentration value after a predetermined time period elapses from the determination that the predicted toner concentration value is smaller than the detected toner concentration value, the controller updates the replenishment amount information so that the replenishment amount indicated in the replenishment amount information increases, and when it is determined that the predicted toner concentration value is greater than the detected toner concentration value after a predetermined time period elapses from the determination that the predicted toner concentration value is smaller than the detected toner concentration value, the controller changes replenishment operation of the toner container.

5. The image forming apparatus according to claim 1, wherein the toner container includes a container screw, the controller controls the container screw to supply toner from the toner container to the developing section by rotating the container screw, the storage stores therein rotation replenishment amount information indicating a rotation replenishment amount that is an amount of toner supplied from the toner container to the developing section by one rotation of the container screw, the controller controls the toner container so that toner in the toner container is supplied to the developing section according to the replenishment amount information in the storage, and the controller changes the rotation replenishment amount indicated in the rotation replenishment amount information based on the predicted toner concentration value and the detected toner concentration value.

6. The image forming apparatus according to claim 1, further including a hygrometer configured to measure a humidity, wherein the controller controls the toner container so that toner in the toner container is supplied to the developing section according to replenishment amount information set depending on the humidity measured by the hygrometer.

7. The image forming apparatus according to claim 1, wherein the controller predicts the predicted toner concentration value using an advection diffusion equation including a diffusion coefficient and an advection coefficient.

8. The image forming apparatus according to claim 1, wherein the controller compares a difference between the predicted toner concentration value and the detected toner concentration value with a predetermined threshold to determine whether the replenishment amount is appropriate or inappropriate, and when it is determined that the replenishment amount is inappropriate, the controller changes the replenishment amount.

* * * * *